United States Patent [19]

Larsen

[11] Patent Number: 4,938,310

[45] Date of Patent: Jul. 3, 1990

[54] SCAFFOLD LIFT

[76] Inventor: William A. Larsen, R.R. 2, Box 31A, Dell Rapids, S. Dak. 57022

[21] Appl. No.: 258,901

[22] Filed: Oct. 17, 1988

[51] Int. Cl.[5] ..... E04G 1/20

[52] U.S. Cl. ..... 182/129; 182/142; 187/2; 187/11

[58] Field of Search ..... 182/129, 142, 103, 145, 182/142; 187/2, 11

[56] References Cited

U.S. PATENT DOCUMENTS

| | | | |
|---|---|---|---|
| 727,407 | 5/1903 | Murphy | 182/145 |
| 2,364,547 | 12/1944 | Olsen | 304/29 |
| 2,621,820 | 12/1952 | O'Sullivan | 214/730 |
| 2,762,659 | 9/1956 | Harlan et al. | 304/29 |
| 2,803,503 | 8/1957 | Borgman | 182/145 |
| 2,829,929 | 4/1958 | Wardell | 187/2 |
| 3,223,199 | 12/1965 | Schwehr | 187/2 |
| 3,313,376 | 4/1967 | Holland | 182/129 |
| 3,752,263 | 8/1973 | Thevenot | 187/2 |
| 3,951,236 | 4/1976 | Schreiber | 187/2 |

*Primary Examiner*—Reinaldo P. Machado
*Attorney, Agent, or Firm*—Steven E. Kahm

[57] ABSTRACT

A device which is easily attached to the side of a scaffold for lifting objects up the side of the scaffold. The device consists of a carriage which has a rectangular frame having guide members with wheels attached at each corner for engaging the pipes of the scaffold frame. The wheels are attached such that the carriage can ride up and down on the scaffold without interference with the scaffold frame supports and cross members. The carriage has a motor attached to it which is connected to a chain drive. There is a chain which runs through the chain drive and attaches to the top of the scaffold frame. The motor and chain drive act on the chain to drive the carriage up and down the scaffold. The chain drive preferably has a brake for use when the carriage is stopped. The carriage frame has a means of attaching a pair of forks. The width of the forks are adjustable on the carriage frame.

7 Claims, 6 Drawing Sheets

SCAFFOLD LIFT

BACKGROUND OF THE INVENTION

In the construction industry where scaffolds are used it is frequently necessary to lift heavy objects from the ground up to the level the workers are at. There have been inventions in the past where a frame and hoist have been attached to a scaffold to lift objects to the workers, however these inventions were complex, cumbersome, expensive and more difficult to assemble and operate than the present invention.

SUMMARY OF THE INVENTION

The invention eliminates the need for a separate structure to be attached to the scaffold to lift the materials needed by the workmen. The invention attaches the lifting mechanism to the side of the scaffold. The lifting mechanism slides up and down the outside of the frame of the scaffold. This eliminates the need for cumbersome frames which would have to be assembled and attached to the scaffold frames as in the prior art.

The lifting mechanism is a simple chain connected to the top of the scaffold and to a motor in the center of the carriage frame which rides up and down the outside of the scaffold. This is much simpler than some of the prior art devices which have a more complex system involving pulleys and gears in their own frames.

DETAILED DESCRIPTION

This invention works with "Safway" brand scaffolds and scaffolds of similar design where there are no obstructions and a smooth surface on the front, back and outside edges of the corner pipes of the scaffold.

Figure 1:
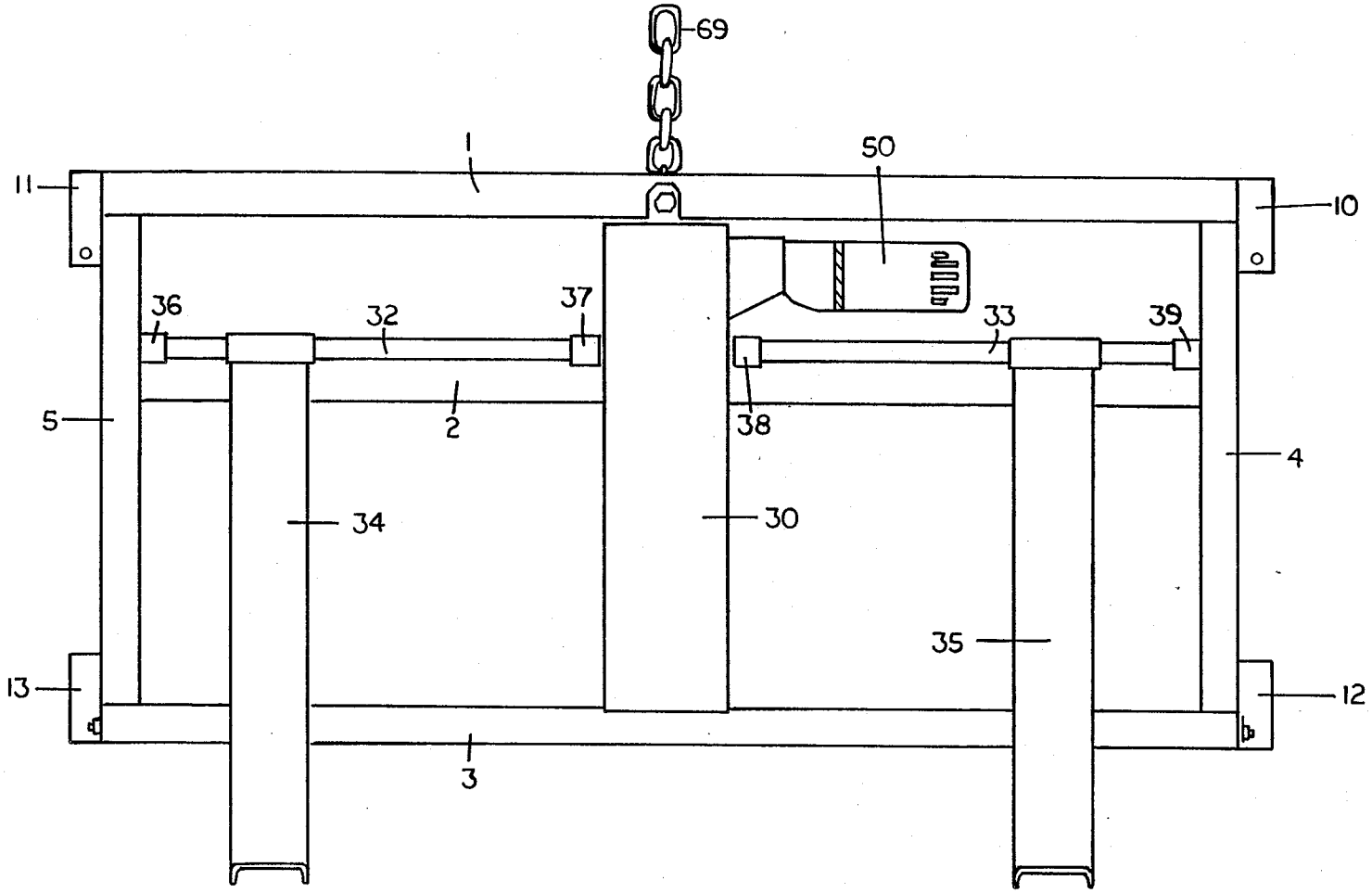
FIG. 1 is a front view of the carriage frame.

FIG. 1 shows a front view of the scaffold lifter carriage. The carriage frame is essentially a rectangle composed of a top frame member 1, a bottom frame member 3, a right side frame member 4, and a left frame member 5. These members are attached to one another at their ends to form a rectangle. In addition there is a middle frame member 2, extending between the right and left frame members 4 and 5 respectively. The middle frame member is mounted closer to the top of the frame than the bottom.

Figure 2:
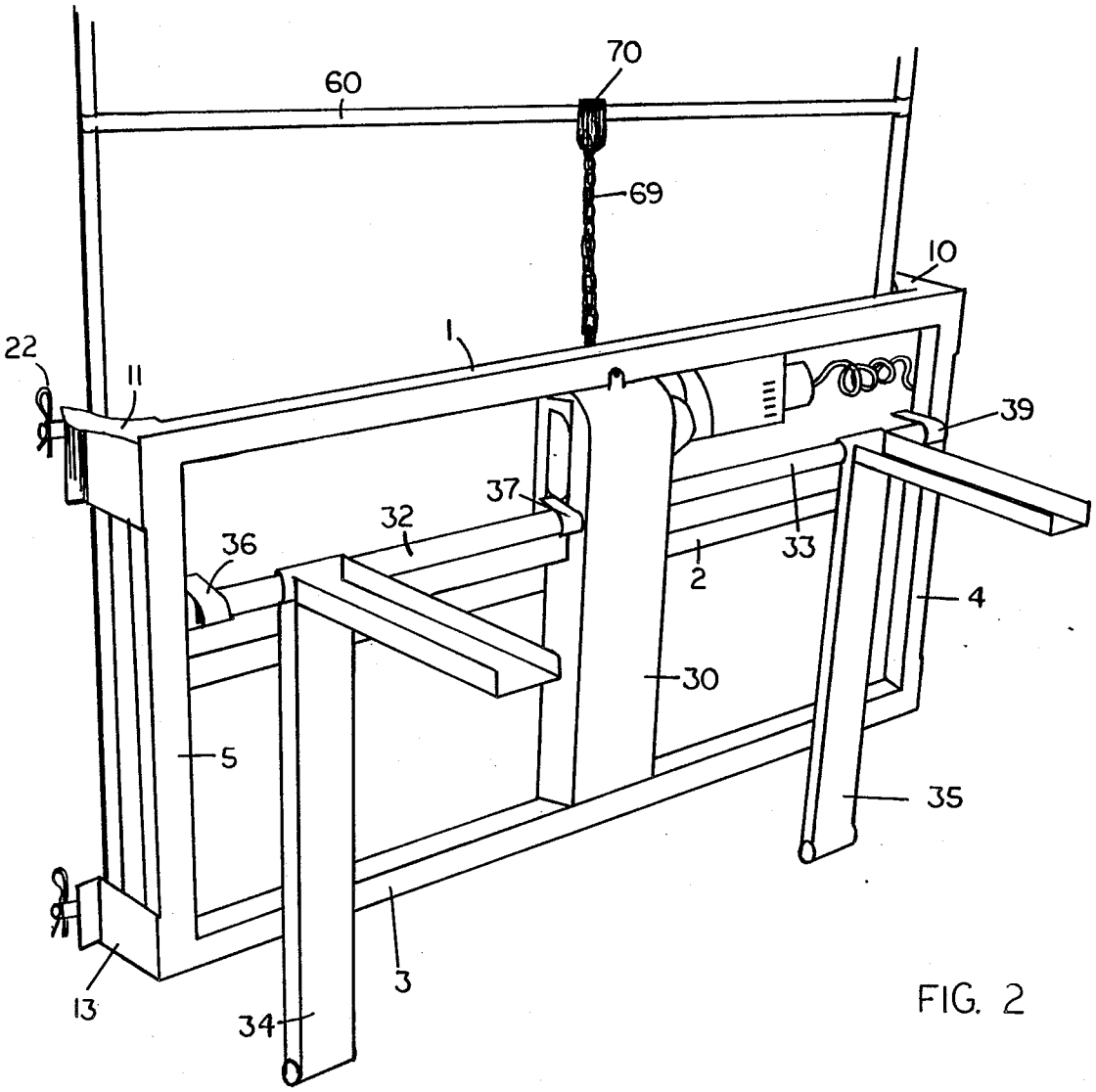
FIG. 2 is a front perspective view of the carriage frame.
Figure 3:
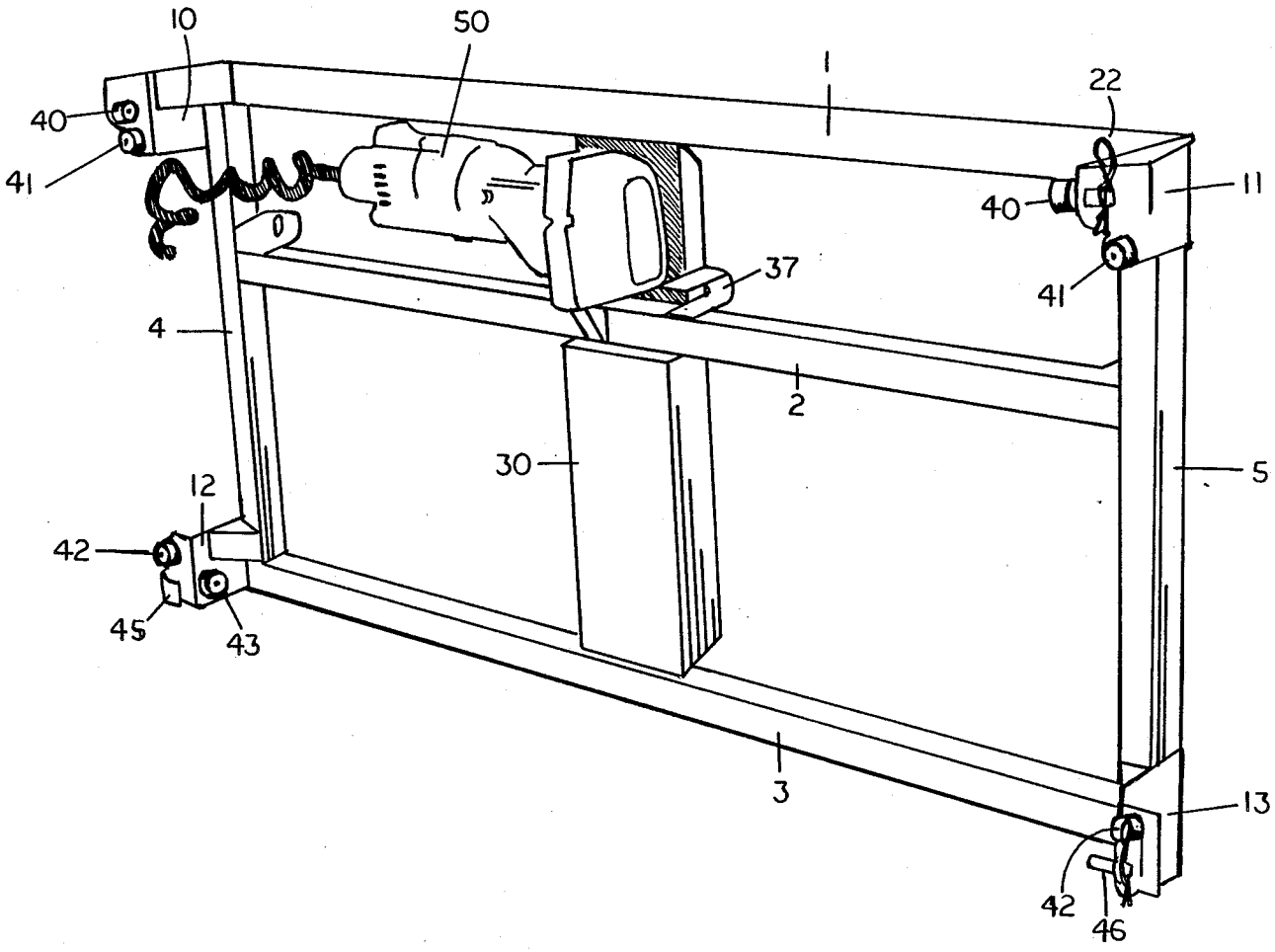
FIG. 3 is a rear perspective view of the carriage frame.

Attached at the four corners of the rectangular carriage frame are guide members to slidably attach the carriage frame to the scaffold. There are four guide members, the upper right guide member 10, the upper left guide member 11, the lower right guide member 12, and the lower left guide member 13. The guide members are attached to the frame members such that they extend perpendicular to the plane of the carriage frame, as best seen in FIGS. 2 and 3. Each guide member has a pair of wheels attached to it. The wheels are attached such that they are perpendicular to each other for stabilizing the carriage's contact with the scaffold.

Figure 4:
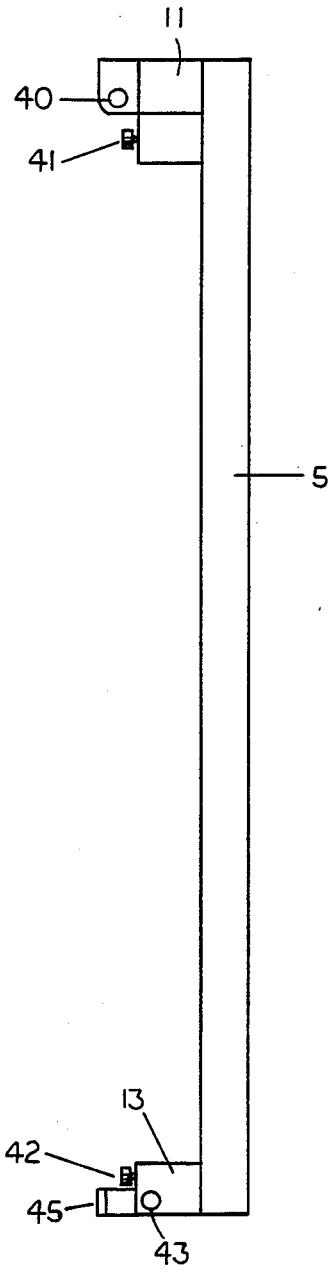
FIG. 4 is a side view of the left frame member and the guide members.
Figure 5:
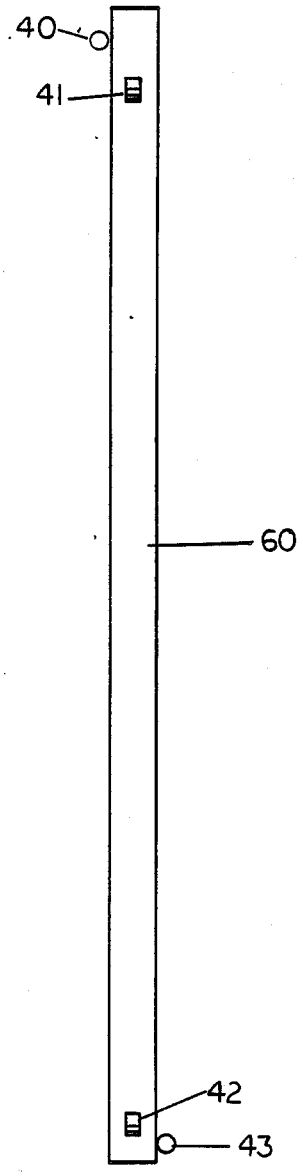
FIG. 5 is a side view of the wheels engaging a scaffold pipe.
Figure 6:
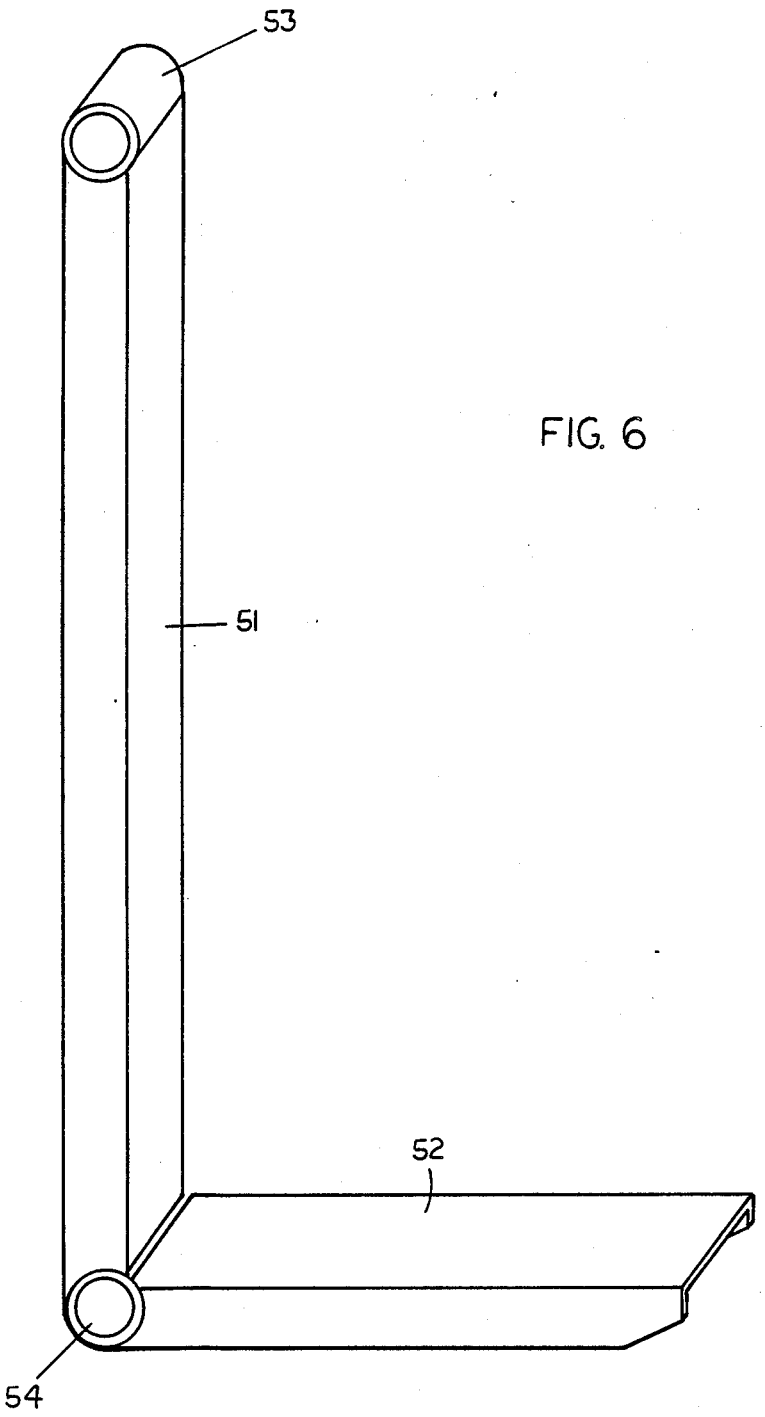
FIG. 6 is a perspective view of a fork.
Figure 7:
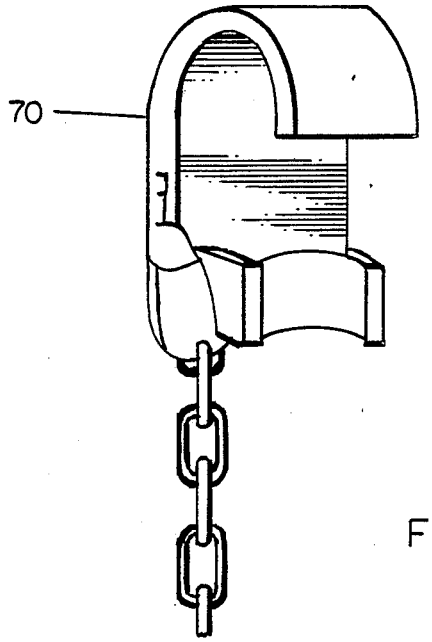
FIG. 7 is a perspective view of the chain bracket.
Figure 8:
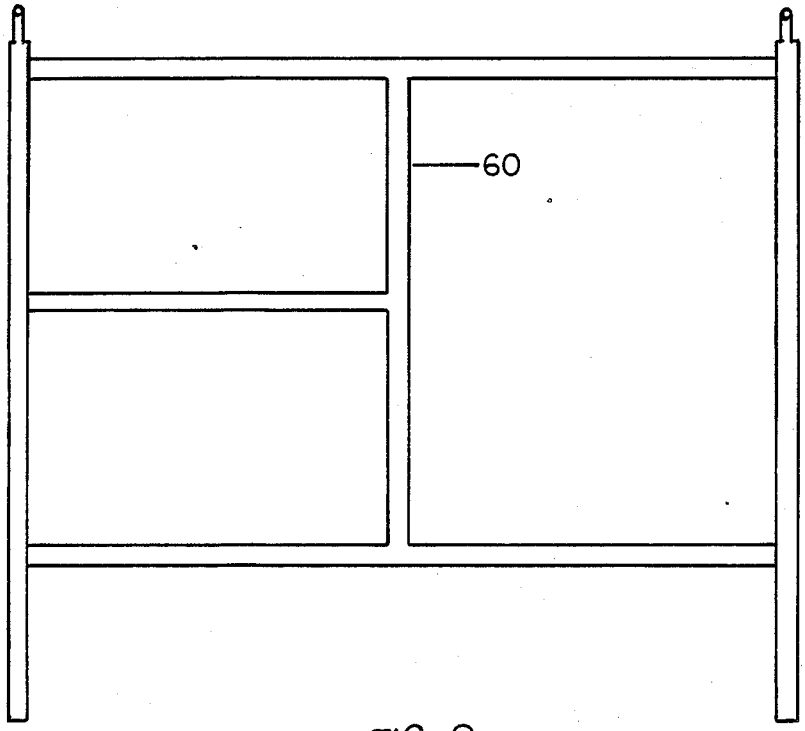
FIG. 8 is a front view of a scaffold frame.

On the top guide members 10 and 11 the wheels are attached such that they are perpendicular to each other. On guide member 11 as shown in FIG. 4 wheel 41, runs along the outside edge of the scaffold pipe and wheel 40 runs along the rear of the scaffold pipe opposite the scaffold from the carriage frame.

Top guide member 11 has a removable pin 22 in the wheels axle for removing the wheel 40 from behind the scaffold which allows the carriage frame to be put on or taken off the scaffold. Thus the carriage is secured to the back and to the outside edge of the scaffold pipe.

On the bottom guide members 12 and 13 one wheel 42 runs along the outside edge of the scaffold pipe and one wheel 43 runs along the front side of the scaffold pipe.

There are stoppers 45 and 46, extending behind the scaffold pipe to ensure that the carriage does not move away from the scaffold.

Similarly on the top guide members 10 and 11 the carriage frame itself acts as a stopper to ensure that the carriage frame will remain positioned next to the scaffold pipes.

The top guide members 10 and 11 are symmetric except that one side top wheel 40, on guide member 11, has an axle which is removable from the carriage frame. This allows the carriage frame to be easily attached to or removed from the scaffold. Similarly the bottom guide members 12, 13 are symmetric accept that on one guide member 13, the stopper 46 is removable from the guide member to allow the carriage frame to be easily attached to or removed from the scaffold pipes.

Another means of attaching the carriage frame to the scaffold is to slide the carriage frame over the top or bottom of the scaffold.

It should be noted that by having the top guide member's wheel 41 behind the scaffold pipe and the bottom guide member wheel 43 on the front of the scaffold pipe that the force on the wheels will be maximized because the load on the bottom front of the carriage will force the bottom of the frame toward the front of the scaffold pipes thus engaging the wheel 43. Conversely the load on the bottom front of the carriage frame will tend to force the wheel 40 onto the rear of the carriage frame.

This arrangement allows the carriage to ride more smoothly up and down the scaffold pipes because the wheels are always engaging the scaffold pipes.

The wheels 41 and 43 are on the outside edges of the scaffold pipes and prevent the carriage from moving to one side or the other with respect to the scaffold thus providing lateral stability.

Preferably the wheel 40 is positioned just behind where it would be relative to wheel 43 allowing for the diameter of the scaffold pipe. This offset is designed to tilt the carriage frame about two degrees. If the forks are perpendicular to the carriage frame this tilt upwards of two degrees helps hold the load on the forks. This also helps force the carriage wheels 40 and 43 against the scaffold frame for smoother operation.

In the middle of the frames width a chain box 30 is attached. The front of the chain box extends from the top frame member 1 to the bottom frame member 3. The rear of the chain box extends from the bottom frame member 3 to the middle frame member 2.

On the top surface of the middle frame member 2 are four "U" shaped fork tube holders 36, 37, 38, 39. Each of which extend out from the edge of the middle frame member 2 such that the base of the "U" is extended slightly more than the diameter of the fork tube 32, 33 away from the edge of the middle frame member, so that when the fork tube is inserted into the slots 53 or 54 on the fork 34 or 35 there is room for the fork's arm 52, to rest against the carriage frame members 2, 3 and hold the forks lifting arms perpendicular to the carriage frame.

The left end fork tube holder 36, is placed at the corner of the middle frame member 2 and the left frame member 5. The left center frame member 37 is placed on the middle frame member 2 next to the chain box 30.

The right center frame member 38 is placed on the middle frame member 2 next to the chain box 30.

The right end fork tube holder 39, is placed at the corner of the middle frame member 2 and the right frame member 4.

The left and right end fork tube holders, 36 and 39 have an end piece to stop the fork tubes from sliding out of the ends.

The left and right center fork tube holders 37, and 38 are up against the chain box 30 which acts as a stopper so that the fork tubes 32 and 33 will not slide out the ends.

The forks 34 and 35 have perpendicular arms 51 and 52. Arm 51 has a round slot 54 on one end. Arms 51 and 52 intersect at slot 55.

The tubes 32 and 33 can be inserted into the slots 53 or 54 and then attached to the carriage frame by inserting the tubes in the fork tube holders. The forks 34 and 35 can then be slid along the tubes 32 and 33 to adjust the distance between them.

If the tubes 32 and 33 are inserted in slots 53 the fork arm 52 can be lowered to the ground to lift a pallet or other objects. If the tubes 32 and 33 are inserted in slots 54 the arms 52 will be at the level of the middle frame member 2, thus the load can be lifted to a higher position when the carriage is at the top of the scaffold.

There is a hoist motor 50 attached between the top frame member 1 and the middle frame member 2. The hoist motor has a chain drive 68 connected to it. The chain drive is centered in the middle of the carriage frame's length and above the center of the chain box 30. Preferably the hoist motor has a brake in it which locks the chain drive in position when the motor is turned off and the brake release when the motor is turned on.

There is a chain 69 which runs through the chain drive 68. One end of the chain connect to the top of the scaffold. The chain then runs through the chain drive and the remainder of the chain is stored in the chain box.

One end of the chain has a chain support bracket 70 which is designed to hook over the top pipe of the scaffold. In one embodiment the chain support bracket has a center scaffold pipe engaging section to stabilize t e chain support bracket from lateral movement on the uppermost scaffold pipe.

The motor connected to the chain drive acts on the chain to propel the carriage frame up and down the outside of the scaffold.

I claim:

1. A scaffold lift which will slidably attach to the frame of a scaffold having a frame made of pipes consisting of a carriage frame having a top frame member, a bottom frame member, a right frame member, and a left frame member attached to each other so as to form a rectangle, and a middle frame member extending parallel to the top and bottom frame members and attached to the right and left frame members, the carriage frame having a front, a back, a top, a length and a plane parallel to the rectangle of the carriage frame, four guide members, one attached at each corner of the carriage frame, extending behind and perpendicular to the plane of the carriage frame, a plurality of wheels on the guide members for engaging the scaffolding frame, a chain, a chain support bracket which is attached to the top of the scaffold frame, a chain drive connected to a motor attached to the carriage frame, the chain running through the chain drive, a means of lifting a load attached to the carriage frame.

2. A scaffold lift which will slidably attach to the frame of a scaffold having a frame made of pipes as in claim 1 where each of the guide members on the corners of the carriage frame have two wheels, and these wheels are perpendicular to each other, one wheel on each guide member is parallel to plane of the carriage frame, it is placed so as to engage the outer edge of the pipe in the scaffold frame, the opposing outer edge wheel give the carriage frame lateral stability on the scaffold frame, one wheel on each guide member is perpendicular to plane of the carriage frame, on the guide members attached at the top of the carriage frame the perpendicular wheel is attached to the guide member so as to fit behind the scaffold pipe, on the guide members attached at the bottom of the carriage frame the perpendicular wheel is attached to the guide member so as to fit in front of the scaffold pipe, the bottom guide member also has a stopper attached to the guide which extends behind the scaffold pipe.

3. A scaffold lift which will slidably attach to the frame, of a scaffold having a frame made of pipes as in claim 2 where the top guide members are longer than the bottom guide members so that the carriage frame is attached to the scaffold frame at approximately a two degree angle.

4. A scaffold lift which will slidably attach to the frame of a scaffold having a frame made of pipes as in claim 3 where the top right guide member has a means of removing the wheel which engages the back of the scaffold pipe and the lower right guide member has a means of removing the stopper from the back of the scaffold pipe so as to more easily attach the carriage frame to the scaffold.

5. A scaffold lift which will slidably attach to the front of a scaffold having a frame made of pipes as in claim 2,3 or 4, where the means of lifting a load attached to the carriage frame is a pair of forks attached to the carriage frame.

6. A scaffold lift which will slidably attach to the frame of a scaffold having a frame made of pipes as in claim 2,3, or 4 where the means of lifting a load attached to the carriage frame is a pair of forks, each fork is comprised of two perpendicular arms attached to each other, there is a slot at the end of one arm and at the junction of the two arms for inserting a tube which slidably supports the forks on the carriage frame, the tubes are inserted in "U" shaped fork tube holders which are attached on the top of the middle frame member.

7. A scaffold lift which will slidably attach to the frame of a scaffold having a frame made of pipes as in claim 2,3, or 4 where the means of lifting a load attached to the carriage frame is a pair of forks, each fork is comprised of two perpendicular arms attached to each other, there is a slot at the end of one arm and at the junction of the two arms for inserting a tube which slidably supports the forks on the carriage frame, the tubes are inserted in a plurality of "U" shaped fork tube holders which are attached on the top of the middle frame member, where the chain drive is centered in the middle of the carriage frame's length, the chain drive is connected to a motor and the motor and chain drive are attached to the carriage frame between the top frame member and the middle frame member, and there is a chain box in the middle of the carriage frame's length, below the chain drive, for storage of the chain, and a chain bracket for attaching the chain to the top of the scaffold frame.

* * * * *